United States Patent [19]

Takashima et al.

[11] Patent Number: 4,891,297

[45] Date of Patent: Jan. 2, 1990

[54] HEAT-SENSITIVE DIAZO RECORDING MATERIAL WITH THIOHYDROQUINONE

[75] Inventors: Masanobu Takashima; Ken Iwakura; Masato Satomura; Kimio Ichikawa, all of Shizuoka, Japan

[73] Assignee: Fuji Photo Film Co.,Ltd., Kanagawa, Japan

[21] Appl. No.: 178,834

[22] Filed: Mar. 25, 1988

Related U.S. Application Data

[63] Continuation-in-part of Ser. No. 14,744, Feb. 13, 1987, abandoned.

[30] Foreign Application Priority Data

Feb. 13, 1986 [JP] Japan ..... 61-29623

[51] Int. Cl.[4] ..... G03C 1/60; B41M 5/18

[52] U.S. Cl. ..... 430/177; 430/138; 430/151; 503/214; 503/218

[58] Field of Search ..... 403/151, 177, 138; 530/214, 218

[56] References Cited

U.S. PATENT DOCUMENTS

| | | | |
|---|---|---|---|
| 3,591,381 | 7/1971 | Gray etal. | 430/177 |
| 4,598,035 | 7/1986 | Usami et al. | 430/138 |
| 4,628,335 | 12/1986 | Igarashi et al. | 503/208 |
| 4,644,376 | 2/1987 | Usami et al. | 430/179 |

FOREIGN PATENT DOCUMENTS

| | | | |
|---|---|---|---|
| 1016889 | 1/1986 | Japan | 503/214 |

*Primary Examiner*—Charles L. Bowers, Jr.
*Attorney, Agent, or Firm*—Sughrue, Mion, Zinn, Macpeak & Seas

[57] ABSTRACT

A heat-sensitive recording material is disclosed. The material comprises a support having provided thereon a recording layer containing one or more diazo compound, a coupling component, and at least one thiohydroquinone derivative as a sensitizing agent.

2 Claims, No Drawings

HEAT-SENSITIVE DIAZO RECORDING MATERIAL WITH THIOHYDROQUINONE

This is a continuation-in-part of application Ser. No. 07/014,744 filed Feb. 13, 1987.

FIELD OF THE INVENTION

The present invention relates to a heat-sensitive recording material, and more particularly, to a diazo type heat-sensitive recording material which can be fixed. In more detail, the present invention relates to a heat-sensitive recording material having excellent storage properties before heat-recording and having high color density at heat-recording, and which can optically be fixed after recording.

BACKGROUND OF THE INVENTION

A leuco color forming type heat-sensitive recording material is generally used as a recording material for heat-sensitive recording systems. However, such a heat-sensitive recording material has defects in that color is formed at unexpected areas due to rough handling, heating or attachment of solvents and the like, and accordingly recorded images are often stained. Recently, a diazo color forming type heat-sensitive recording material, which does not have the above defects, has been studied very extensively. It is disclosed, for example, in Japanese Patent Application (OPI) No. 123086/82 (the term "OPI" as used herein means an "unexamined published application") and in the bulletin of The Journal of Image Electronic Society, 11, 290 (1982) that heat-recording is conducted on a recording material containing diazo compounds, a coupling component and a basic component (including substances which become basic by heating) and thereafter the recording material is exposed to light to decompose the unreacted diazo compounds, resulting in cessation of color formation. In fact, color formation at the non-recorded area can be stopped (hereinafter referred to as "fixation") by this method. However, in the recording material of this type, pre-coupling gradually occurs during storage before use, and therefore unfavorable color formation (fog) occurs in many cases. In this case, the precoupling can be prevented by making one of the color forming components exist in the form of discontinuous particles so as to prevent it from contact with other components. However, the storage stability before recording is not sufficient and there is a defect that the color forming property by heating decreases. Further, it is disclosed, for example, in Japanese Patent Application (OPI) No. 123086/82 that diazo compounds and a coupling component are incorporated into each layer separately in order to minimize the contact between the color forming components. Storage stability before recording can be improved by the above method, but the color forming property by heating largely decreases and the recording material of this type can not respond to high speed recording having a short pulse width and thus is not suitable for practical use. Still further, in order to realize the satisfactory storage stability before recording and satisfactory color forming property by heating, it is known that any one of a coupling component and a basic substance can be encapsulated by a non-polar wax-like substance (as disclosed in Japanese Patent Application (OPI) Nos. 44141/82 and 142636/82) or by a hydrophobic high molecular weight substance (as disclosed in Japanese Patent Application (OPI) No. 192944/82) in order to separate the coupling component and/or basic substance from other components. This encapsulation comprises dissolving a wax or a high molecular weight substance in suitable solvents, and dissolving or dispersing a color forming component into the thus obtained solution to form capsules, whose function is different from that of capsules where a core is covered with a shell. For the above reason, when a color forming component is dissolved to form capsules, the color forming component does not become a core substance for a capsule, but does disperse with the encapsulated substance homogeneously. Therefore, pre-coupling occurs at the wall of the capsule during storage, resulting in poor storage stability before recording. As a result, when a color forming component is dispersed to form a capsule, it is necessary to heat and melt the wall of the capsule in order to cause the color forming reaction. Thus results in poor color forming properties by heating. Further, the above-described method has a manufacturing problem in that the solvents used for dissolving the wax or the high molecular weight substance should be removed after the capsule is formed. Therefore the above method is not sufficiently satisfactory.

In order to solve the above problems, another encapsulation method has been studied, and it was found that the problem could be solved by an excellent heat-sensitive recording material prepared by incorporating at least one of the color forming components into a core substance and forming a wall around the core substance by polymerization to obtain microcapsules.

However, in the heat-sensitive recording material prepared by the above-described microencapsulation method, the optical density at the area of recorded images appears to decrease upon long storage after heat-recording in many cases. Therefore, further improvement has been required.

SUMMARY OF THE INVENTION

A first object of the present invention is to provide a heat-sensitive recording material having excellent storage stability before recording, quick heat responsive properties, high color forming properties by heating and reduced decrease of recorded image density upon long storage after heat-recording.

A second object of the present invention is to provide a heat-sensitive recording material which is capable of optically decomposing unreacted diazo compounds after recording and fixing them.

A third object of the present invention is to provide a heat-sensitive recording material having excellent manufacturing properties.

DETAILED DESCRIPTION OF THE INVENTION

As a result of extensive studies, the inventors of the present invention have found that the above-described problems can be solved by providing a heat-sensitive recording material comprising a support having provided thereon a recording layer containing one or more diazo compounds, a coupling component, and at least one thiohydroquinone derivative as a agent. It is preferred that any one of the diazo compounds and the coupling component should be contained in a microcapsule.

In the microcapsules generally used in a heat-sensitive recording material, the microcapsules are damaged by heating or by pressure so that the reactive substance contained in the core of the microcapsule makes contact with the reactive substance outside the microcapsule, thereby causing a color forming reaction, whereas in the microcapsules of the present invention, reactive substances contained in the core and present outside of the core of the microcapsule are transferred through the wall of the microcapsule by heating so that those substances contact and react with each other.

The inventors of the present invention have studied the heat-sensitive recording material using the above-described microcapsules and have found that it is remarkably effective to incorporate thiohydroquinone derivatives as a density improving agent(s) in addition to the above-described diazo compound and a coupling component into a recording layer in order to obtain a heat-sensitive recording material having excellent storage stability before recording, good color forming properties by heating and reduced decrease of the optical density of recorded images caused by long storage after heat-recording.

Preferred examples of thiohydroquinone derivatives of the present invention which serve as density improving agents are those compounds having the formula (I).

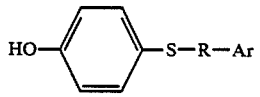

(I)

wherein Ar represents a substituted or unsubstituted aryl group and R represents a substituted or unsubstituted divalent group having 10 or less carbon atoms.

In more detail, Ar may be a single ring, a condensed ring, an aromatic ring composed of only carbon atoms or a heterocyclic ring having at least one of a nitrogen atom, sulfur atom or oxygen atom.

For example, Ar includes a benzene ring, a naphthalene ring, a benzazolen ring, a pyridine ring, a pyrrole ring, a pyrimidine ring, a furan ring, a benzofuran ring, a thiophene ring, and an indole ring, which may have a plural number of substituents such as $R_1$ and $R_2$ hereinafter described.

In the thiohydroquinone derivative represented by formula (I), those compounds represented by formulae (I-a) and (I-b) are preferred.

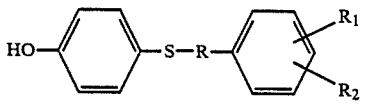

(I-a)

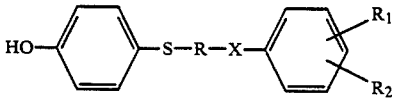

(I-b)

Among the compounds represented by the formulae (I-a) and (I-b), those compounds having a melting point of from 50° to 250° C., particularly from 65° to 200° C. are preferred in the present invention. Further, thiohydroquinone derivatives having a water solubility of 4 or lower, particularly 0.5 or lower are preferred, in view of durability of the recording material.

In the above formulae (I-a) and (I-b), $R_1$ and $R_2$ each represents a hydrogen atom, an alkyl group, an aryl group, an alkoxy group, an aryloxy group, a halogen atom, an acyl group, a carbamoyl group, a sulfamoyl group, a substituted amino group, a cyano group, a nitro group, a carboxyl group or a sulfo group.

Also, $R_1$ and $R_2$ may bond to form a ring.

It is particularly preferred that $R_1$ is an alkyl group having from 1 to 12 carbon atoms, a hydrogen atom, an alkoxy group having from 1 to 12 carbon atoms, an aryloxy group having from 6 to 12 carbon atoms, a chlorine atom, or a fluorine atom, $R_2$ is an alkyl group having from 1 to 12 carbon atoms, an alkoxy group having from 1 to 12 carbon atoms, an aryloxy group having from 6 to 9 carbon atoms, an alkoxy group, a thioalkoxy group or a hydrogen atom. These alkyl groups can form a linear chain, a branched chain or a ring and can be substituted. Examples of the substituents are an aryl group, a halogen atom, a cyano group, an acyloxy group, an aryloxy group and an acyl group.

Specific examples of $R_1$ and $R_2$ are a hydrogen atom, a methyl group, an ethyl group, a propyl group, an isopropyl group, allyl group, a dimethylbutyl group, a t-amyl group, a hexyl group, an isoamyl group, a cyclohexyl group, a cyclohexylmethyl group, a chlorine atom, a methylcyclohexyl group, a chloroethyl group, a β-acetoxyethyl group, a 3-ketobutyl group, a benzyl group, an α- and β-phenethyl group, a vinyl group, a methoxy group, a thiomethoxy group, an ethoxy group, a propoxy group, a butoxy group, a diethylamino group, a butylamino group, a butoxycarbonyl group, an ethylhexyloxycarbonyl group, an N-hexylcarbamoyl group, a β-acetoxyethoxy group, a phenoxyethyl group, a 2-chlorophenoxy-2-methylethoxy group, a dichlorophenoxy group, a dichlorophenyl group, a trimethylphenyl group, an amino group, a nitro group, a glycidyl group, a dihydroxypropoxy group, methoxycarbonylpropoxy group and a phenyl group.

R in the formulae (I-a) and (I-b) preferably represents a substituted or unsubstituted alkylene group having 6 or less carbon atoms. The substituents for R are those substituents described above for $R_1$ and $R_2$. Particularly preferred substituents are a hydroxyl group, a halogen atom, an acyloxy group and an acyl group. In formula (I-a), R is preferably a methylene or ethylene group and more preferably a methylene group.

In formula (I-b), X represents an oxygen atom or a sulfur atom.

Specific examples of the compounds of formula (I) are illustrated as follows.

(1) 4-hydroxyphenylthiosphenylmethane
(2) 4-hydroxyphenylthio(4-chlorophenyl)methane
(3) 4-hydroxyphenylthio(4-methylphenyl)methane
(4) 4-hydroxyphenylthiophenylethane
(5) 1-(4-hydroxyphenylthio)-2-phenoxyethane
(6) 1-(4-hydroxyphenylthio)-4-phenoxybutane
(7) 1-(4-hydroxyphenylthio)-2-(4-methylphenoxy)ethane
(8) 1-(4-hydroxyphenylthio)-2-(3-methylphenoxy)ethane
(9) 1-(4-hydroxyphenylthio)-2-(4-methoxyohenoxy)ethane
(10) 1-(4-hydroxyphenylthio)-2-(4-chlorophenoxy)ethane
(11) 1-(4-hydroxyphenylthio)-2-(2-naphthyloxy)ethane
(12) 1-(4-hydroxyphenylthio)-2-phenylthioethane
(13) 1,2-bis(4-hydroxyphenylthio)ethane The thiohydroquinone derivative is preferably coated in an amount of from 1 to 8 g/m², more preferably from 3 to 6 g/m².

The diazo compounds used in the present invention are diazonium salts represented by the formula $Ar'N_2^+X^-$, wherein Ar' represents an aromatic part, $N_2^+$ represents a diazonium group and $X^-$ represents an acidic anion. Further, the diazo compounds are those that can form a color by the reaction with a coupling component and can be decomposed by light.

Aromatic parts are preferably those having the following formula,

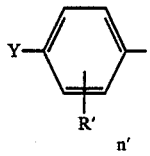

In the formula, Y represents a hydrogen atom, a substituted amino group, an alkoxy group, an aryloxy group, an arylthio group, an alkylthio group or an acylamino group, R' represents a hydrogen atom, an alkyl group, an alkoxy group, an aryloxy group, an arylamino group or a halogen atom (I, Br, Cl, F). n' is 1 or 2.

Substituted amino groups of Y are preferably a monoalkylaxino group, a dialkylamino group, an arylamino group, a morpholino group, a piperidino group or a pyrrolidino group.

Specific examples of diazonium compounds which form salts are 4-diazo-1-dimethylaminobenzene, 4-diazo-1-diethylamnobenzene, 4-diazo-1-dipropylaminobenzene, 4-diazo-1-methylbenzylaminobenzene, 4-diazo-1-dibenzylaminobenzene, 4-diazo-1-ethylhydroxyethylaminobenzene, 4-diazo-1-diethylamino-3-methoxybenzene, 4-diazo-4-dimethylamino-2-methylbenzene, 4-diazo-1-benzoylamino-2,5-diethoxybenzene, 4-diazo-1-morpholinobenze, 4-diazo-1-2,5-diethoxybenzene, 4-diazo-1-morpholino-morpholino-2,5-dibutoxybenzene, 4-diazo-1-anilinobenzene, 4-diazo-1-toluylmercapto-2,5-diethoxybenzene, 4-diazo-1,4-methoxybenzoylamino-2,5-diethoxybenzene, 4-diazo1-pyrrolidino-2-ethylbenzene.

Specific examples of an acidic auion are $C_nF_{2n+1}COO^-$ (n is an integer of from 3 to 9), $C_mF_{2m+1}SO_3^-$ (m is an integer of from 2 to 8), $C_lF_{2l+1}SO_2)_2CH^-$ (l is an integer of from 1 to 18), $B(C_6H_5)_4^-$, $Bf_4$and $Pf_6^-$.

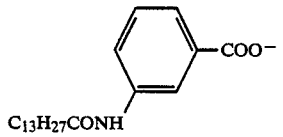

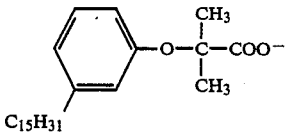

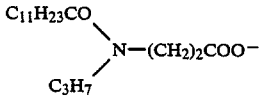

-continued

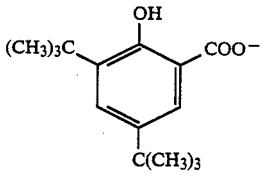

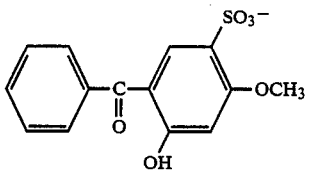

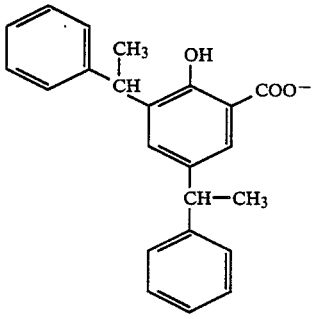

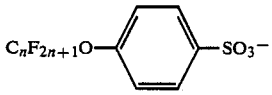

(n is an integer of from 3 to 9).

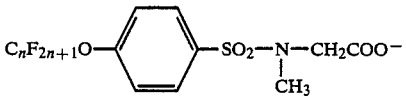

(n is an integer of from 3 to 9).

The acidic anion is particularly preferably one containing a perfluoroalkyl group or a perfluoroalkenyl group or $PF_6^-$ because increase of fog during storage before recording is reduced.

Specific examples of diazo compounds (diazonium salts) are illustrated below.

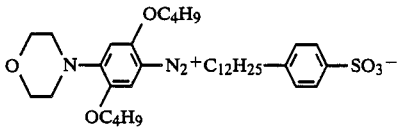

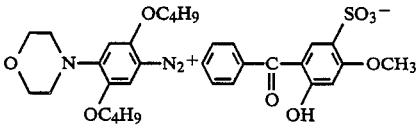

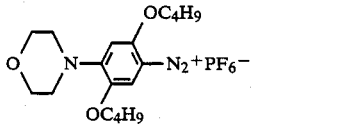

-continued

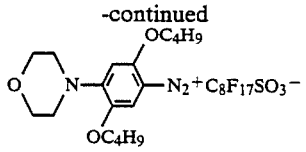

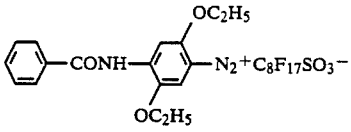

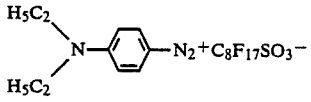

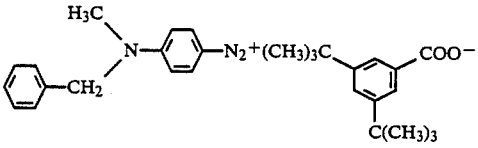

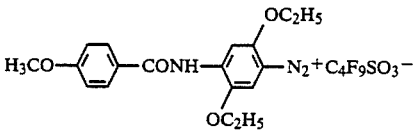

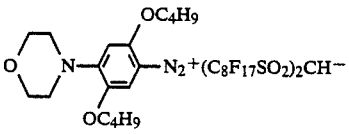

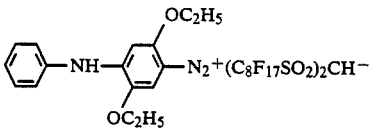

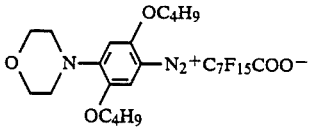

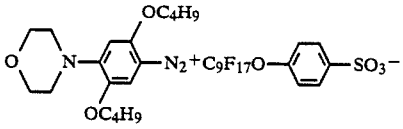

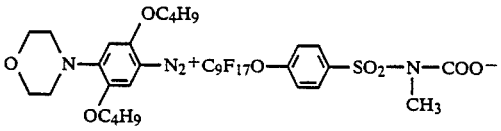

The coupling components used in the present invention are those which can form color by a coupling reaction with diazo compounds (diazonium salts) in a basic environments. Specific examples thereof include resorcinol, phloroglucinol, sodium 2,3-dihydroxynaphthalene-6-sulfonate, 1-hydroxy-2-naphthoic acid morpholinopropylamide, 1,5-dihydroxynaphthalene, 2,3-dihydroxynaphthalene, 2,3-dihydroxy-6-sulfanilnaphthalene, 2-hydroxy-3-naphthoic acid morpholinopropylamide, 2-hydroxy-3-naphthoic acid anilide, 2-hydroxy-3-naphthoic acid-2'-methylanilide, 2-hydroxy-3-naphthoic acid ethanolamide, 2-hydroxy-3-naphthoic acid octylamide, 2-hydroxy-3-naphthoic acid-N-dodecyloxypropylamide, 2-hydroxy-3-naphthoic acid tetradecylamide, acetoanilide, acetoacetoanilide, benzoylacetoanilide, 1-phenyl-3-methyl-5-pyrazolone, 1-(2',4',6'-trichlorophenyl)-3-benzamide-5-pyrazolone, 1-(2',4',6'-trichlorophenyl)-3-anilino-5-pyrazolone and 1-phenyl-3-phenylacetoamide-5-pyrazolone and the like. Images having optional color tone can be obtained by variable combinations of these coupling components.

It is preferable to add basic substances to accelerate color formation to the heat-sensitive recording material of the present invention. Such basic substances are those that are hardly soluble or insoluble in water or those that generate alkaline condition by adding heat.

The basic substances include organic and inorganic ammonium salts, organic amines, amides, urea, thiourea and the derivatives thereof, and nitrogen-containing compounds such as thiazoles, pyrroles, pyrimidines, piperadines, guanidines, indoles, imidazoles, imidazolines, triazoles, morpholines, piperidines, amidines, formamidines and pyridines. Specific examples thereof include ammonium acetate, tricyclohexylamine, tribenzylamine, octadecylbenzylamine, stearylamine, allylurea, thiourea, methylthiourea, allylthiourea, ethylenethiourea, 2-benzylimidazole, 4-phenylimidazole, 2-phenyl-4-methyl-imidazole, 2-undecylimidazoline, 2,4,5-trifuryl-2-imidazoline, 1,2-diphenyl-4,4-dimethyl-2-imidazoline, 2-phenyl-2-imidazoline, 1,2,3-tiiphenylguanidine, 1,2-ditollylguanidine, 1,2-dicyclohexylguanidine, 1,2,3-tricyclohexylguanidine, guanidine trichloroacetate, N,N'-dibenzylpiperazine, 4,4'-dithiomorpholine, morpholinium trichloroacetate, 2-amino-benzothiazole and 2-benzoylhydrazino-benzothiazole. These basic substances can be used in combination.

In the present invention, reactive substances contained in the core substance of a microcapsule are dissolved or dispersed by a water-insoluble organic solvent to form an emulsion, and then a wall of a microcapsule is formed therearound by polymerization. Organic solvents having a boiling point of 180° C. or higher are preferred. Specific examples thereof are phosphate, phthalate, other carboxylic acid esters, fatty acid amides, alkylated biphenyls, alkylated terphenyls, chlorinated paraffins, alkylated naphthalenes, and diaryl ethanes, and the like. More specific examples are tricresyl phosphate, trioctyl phosphate, octyldiphenyl phosphate, tricyclohexyl phosphate, dibutyl phthalate, dioctyl phthalate, dilauryl phthalate, dicyclohexyl phthalate, butyl oleate, diethylene glycol dibenzoate, dioctyl sebacate, dibutyl sebacate, dioctyl adipate, trioctyl trimellitate, acetyltriethyl citrate, octyl maleate, dibutyl maleate, isopropyl biphenyl, isoamyl biphenyl, chlorinated paraffin, diisopropyl naphthalene, 1,1'-ditollylethane, 2,4-ditertiary aminophenol, and N,N-dibutyl-2-buthoxy-5-tertiary octylaniline.

Among those solvents, ester solvents such as dibutyl phthalate, tricresyl phosphate, diethyl phthalate or dibutyl maleate are particularly preferred.

The microcapsule of the present invention is prepared by emulsifying the core substance containing reactive substances and thereafter forming a wall made of a high molecular weight substance around the oil drop. A reactant which forms a high molecular weight substance is added inside and/or outside of the oil drop. Specific examples of the high molecular weight substances are polyurethane, polyurea, polyamide, polyester, polycarbonate, urea-formaldehyde resin, a melamine resin, polystyrene, styrene-methacrylate copolymer, styrene-acrylate copolymer, gelatin, polyvinyl pyrrolidone and polyvinyl alcohol The high molecular weight substances can be used in combination. Preferred high molecular weight substances are polyurethane, polyurea, polyamide, polyester and polycarbonate, and the most preferred substances are polyurethane and polyurea.

For preparing the wall of a microcapsule of the present invention, the method of microencapsulation by polymerizing reactants from the inside of an oil drop is the most effective. That is, in accordance with the above method, a capsule which is preferably used for a recording material having a good storage stability before recording and having an uniform particle size can be prepared in a short time.

The above method and the specific examples of the compounds are disclosed in U.S. Pat. Nos. 3,726,804 and 3,796,669.

When polyurethane is used as a material for the wall, the microcapsule wall is prepared by mixing polyhydric isocyanate and a second substance, for example, polyol, which forms a capsule wall by the reaction with polyhydric isocyanate in the oily liquid to be encapsulated, emulsifying and dispersing the mixture in water and causing a reaction to form a high molecular weight wall on the surface of an oil drop by increasing the temperature. In this case, an auxiliary solvent having a low boiling point and having high dissolving power can be used in oily liquid.

In this instance, polyisocyanate and the second substance to be reacted, for example, polyol and polyamine are disclosed in U.S. Pat. Nos. 3,281,383, 3,773,695, 3,793,268, Japanese Patent Publication Nos. 40347/73 and 24159/74 and Japanese Patent Application (OPI) Nos. 80191/73 and 84086/73. These can be used in the present invention.

Tin salt can be used in combination to accelerate a urethanated reaction.

It is preferred that polyhydric isocyanate be used as a first wall forming substance and polyol be used as a second wall forming substance in order to increase storage stability before recording. Heat permeability of the reacted substance can be optionally varied by varying the combination of the first and the second substances.

The polyhydric isocyanate to be used as a first wall forming substance includes diisocyanate such as m-phenylene diisocyanate, p-phenylene diisocyanate, 2,6-tolylene diisocyanate, 2,4-tolylene diisocyanate, naphthalene-1,4-diisocyanate, diphenylmethane-4,4'-diisocyanate, 3,3'-dimethoxy-4,4'-biphenyl-diisocyanate, 3,3'-dimethyldiphenylmethane-4,4'-diisocyanate, xylylene-1,4-diisocyanate, 4,4'-diphenylpropane diisocyanate, trimethylene diisocyanate, hexamethylene diisocyanate, propylene-1,2-diisocyanate, butylene-1,2-diisocyanate, cyclohexylene-1,2-diisocyanate, or cyclohexylene-1,4-diisocyanate; triisocyanate such as 4,4',4''-triphenylmethane triisocyanate or toluene-2,4,6-triisocyanate; tetraisocyanate such as 4,4'-dimethyldiphenylmethane-2,2',5,5'-tetraisocyanate; and isocyanate prepolymer such as an adduct product of hexamethylene diisocyanate and trimethylol propane, an adduct product of 2,4-tolylene diisocyanate and trimethylol propane, an adduct product of xylylene diisocyanate and trimethylol propane, and an adduct product of tolylene diisocyanate and hexane triol.

The polyol as a second wall forming substance includes aliphatic and aromatic polyhydric alcohol, hydroxypolyester and hydroxy polyalkylene ether. The preferred polyol is a polyhydroxy compound having a molecular weight of 5,000 or less and having the following groups (A), (B), (C) or (D) between two hydroxy groups in the molecule.

(A) Aliphatic hydrocarbon group having from 2 to 8 carbon atoms (B)

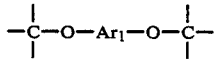

(C)

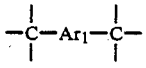

(D)

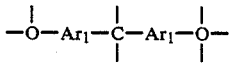

In the above groups, $Ar_1$ in (B), (C) and (D) is a substituted or unsubstituted aromatic part. Ar may be a monocycle or a condensed ring, and the preferred is a benzene ring and a naphthalene ring in view of handling. The aliphatic hydrocarbon group in (A) has a fundamental structure of $-C_{n''}H_{2n''}-$ wherein n represents an integer of 1 or more and the structure may have a substituent. The preferred substituent is an alkyl group and a hydroxyl group and the like.

Specific examples of (A) are ethylene glycol, 1,3-propanediol, 1,4-butanediol, 1,5-pentanediol, 1,6-hexanediol, 1,7-heptanediol, 11,8-octanediol, propylene glycol, 2,3-dihydroxybutane, 1,2-dihydroxybutane, 1,3-dihydroxy-butane, 2,2-dimethyl-1,3-propanediol, 2,4-pentanediol, 2,5-hexanediol, 3-methyl-1,5-pentanediol, 1,4-cyclohexanedimethanol, dihydroxycyclohexane, diethylene glycol, 1,2,6-trihydroxyhexane, phenylethylene glycol, 1,1,1-trimethylol propane, hexanetriol, pentaerythritol and glycerine.

Specific examples of (B) are a condensed product of aromatic polyhydric alcohol and alkylene oxide such as 1,4-di(2-hydroxyethoxy)benzene or resorcinol dihydroxyethylether.

Specific examples of (C) are p-xylylene glycol, m-xylylene glycol and $\alpha,\alpha'$-dihydroxy-p-diisopropyl benzene.

Specific examples of (D) are 4,4'-dihydroxydiphenylmethane, 2-(p,p-dihydroxydiphenylmethyl)-benzylalcohol, an adduct product of bisphenol A with ethylene oxide and an adduct product of bisphenol A with propylene oxide. Polyol is preferably used in such an amount that the hydroxyl group is used in an amount of 0.02 to 2 moles per mole of isocyanate group.

A water-soluble high molecular weight substance can be used to prepare a microcapsule and can be any one of water-soluble anionic high molecular weight substances, nonionic high molecular weight substances and amphoteric high molecular weight substances. An anionic high molecular weight substance can be a natural or synthetic substance and those having $-COO^-$, $-SO_3^-$ and the like can be used. Natural anionic high molecular weigh substances include gum arabic and alginic acid and semi-synthetic substances include carboxymethyl cellulose, phthalated gelatin, sulfated starch, sulfated cellulose and lignin sulfonic acid.

Synthetic anionic high molecular weight substances include maleic anhydride copolymers (including hydrolysis compounds) polymers and copolymers of acrylate (including methacrylate), polymers and copolymers of vinyl benzene sulfonate and carboxy modified polyvinyl alcohol.

The nonionic high molecular weight substance includes polyvinyl alcohol, hydroxyethyl cellulose and methyl cellulose.

The amphoteric compound includes gelatin and the like.

These water-soluble high molecular weight substances are used as a 0.01 to 10 wt % aqueous solution. The particle size of a microcapsule is adjusted to be 20 μm or less. Generally when the particle size thereof exceeds 20 μm, the quality of printed images becomes inferior in many cases.

Particularly when heating by a thermal head is conducted from the side of a coated layer, the particle size is preferably 8 μm or less in order to prevent for caused from pressure.

In the present invention, diazo compounds and a coupling component, which are main components, and a basic substance, which is used if necessary, are used as a core substance of a microcapsule. And any one, two or three of the above compounds can be employed as a core material in a microcapsule. When two of the substances are included in a core substance of a microcapsule, they may be included in each microcapsule respectively or they may be included in one microcapsule when three of them are included in a core substance of a microcapsule, they cannot be included in one microcapsule simultaneously, but there are variable combinations of three components to be incorporated as a core material. The other components which are not incorporated as a core material of a microcapsule are incorporated into a heat-sensitive recording layer outside the microcapsule.

The thiohydroquinone derivatives of the present invention can be incorporated inside or outside of the core of a microcapsule.

A microcapsule can be prepared from an emulsion containing 0.2 wt % or more of components to be encapsulated.

Whenever diazo compounds, a coupling component and a basic substance, if necessary, are included inside of a microcapsule or are included in a heat-sensitive layer outside of a microcapsule, it is preferred that the coupling component is used in an amount of 0.1 to 10 parts by weight, and the basic substance is used in an amount of 0.1 to 20 parts by weight per part by weight of diazo compounds. It is also preferred that the diazo compounds are coated in an amount of 0.05 to 5.0 g/m$^2$.

When diazo compounds, a coupling component and a basic substance are not microencapsulated, they are preferably used as a solid dispersion together with a water-soluble high molecular weight substance which are dispersed with a sand mill or the like. The preferable water-soluble high molecular weight substance used therein is that used for preparing a microcapsule. The concentration of the water-soluble high molecular weight substance is from 2 to 30 wt %, and diazo compounds, a coupling component and a basic substance are introduced into the solution of the water-soluble high molecular weight substance in an amount of from 5 to 40 wt % respectively.

The particle size of the dispersion is preferably 10 μm or less.

Compounds such as ether, phenol, sulfonamide, carboxylic acid amide, ester, ketone, aryl or alkanol can be used together with thiohydroquinone derivatives in the heatsensitive recording material of the present invention in order to improve the color forming property by heating.

Specific examples thereof include ethers such as 2-benzyloxynaphthalene, 1-p-biphenyloxy-2-phenylethane, 2-benzyloxynaphthalene, 2-phenoxyacetyloxynaphthalene, 2-p-chlorobenzyloxynaphthalene, 1-hydroxy-2-phenoxycarbonyl-naphthalene, 1,4-bis-phenoxybutane, 1,2-bis-m-tollyloxyethane, 1-phenoxy-2-p-ethylphenoxyethane, 1,2-diphenoxyethane, 1-phenoxy-2-p-chlorophenoxyethane, bis(phenoxyethyl-)oxalate, 1-phenoxy-2-p-methoxyphenoxyethane, β-chloroethoxynaphthalene, 1-phenoxy-2-p-tollyloxyethane, bis(phenoxyethyl)carbonate, biphenyl-β-methoxyethyl ehter, p-biphenyl-β-cyclohexyloxy ethyl ether, β-cyanoethoxynaphthalene, β-chloroethoxy-p-biphenyl, 2-phenoxyphenyloxycarbonylphenol, 2-p-biphenyloxycarbonylphenol, 2-β-naphthyloxycarbonylphenol, bis(2-p-methoxyphenoxyethyl)ether, bis(2-p-ethoxyphenoxyethyl)ether, bis(2-p-methoxyphenoxyethoxy)methyl ether, or 1,2-bis-4-methoxythiophenoxy ethane, phenols such as butyl phenol, p-t-octylphenol, p-α-cumylphenol, p-t-pentylphenol, 2,5-dimethylphenol, 2,4,5-tri-methylphenol, 3-methyl-4-isopropylphenol, p-benzylphenol, o-cyclohexylphenol, p-(diphenylmethyl)phenol, p-(α,α-diphenylethyl)-phenol, o-phenylphenol, ethyl p-hydroxybenzoate, chloropyl p-hydroxybenzoate, butyl p-hydroxybenzoate, benzyl p-hydroxybenzoate, p-methoxyphenol, p-butoxyphenol, p-heptyloxyphenol, p-benzyloxyphenol, 3-hydroxyphthalic acid, dimethylvanillin, 2,5-diethylphenol, 1,1-bis(4-hydroxyphenyl)dodecane, 1,1-bis(4-hydroxyphenyl)-2-ethylhexane, 1,1bis(4-hydroxyphenyl)-2-methyl-pentane, 2,2-bis(4-hydroxyphenyl)-heptane, vanillin, 2-t-butyl-4-methoxyphenol, 2,6-dimethoxyphenol, 2,2'-dihydroxy-4-methoxybenzophenone, β-resorcinol acid phenoxyethyl ester, orsellinic acid-α-methylbenzyl ester or methyl hydroxy cinnamate, sulfoneamides such as ethylbenzene sulfonamide, toluene sulfonamide, methoxybenzene sulfonamide, ethyltoluene sulfonamide, chloroethoxy benzene sulfonamide, (iso)propylbenzene sulfonamide, ethoxytoluene sulfonamide, t-amylbenzene sulfonamide, diethylbenzene sulfonamide, allylbenzene sulfonamide, ethoxybenzene sulformiade, cyclohexylbenzene sulfonamide; benzamide, m-methoxybenzamide, methylbenzamide, ethylbenzamide, iso-propylbenzamide, butylbenzamide, t-amylbenzamide, cyclohexylbenzamide, dimethylbenzamide, nicotinamide, picoline amide, naphthoamide, phenylbenzamide, chlorobenzamide, o-chlorobenzamide, methoxychlorobenzamide, methoxytoluamide, ethoxybenzamide, butylbenzamide, dimethylnaphthoamide, tri-methylbenzamide, dimethylchlorobenzamide, dimethoxychlorobenzamide, dimethox-ybenzamide, diethoxybenzamide, chlorophenoxyacetoamide, pivaloylamide, 2-ethylhexanoic acid amide, p-acetoxybenzamide, diethylaminobenzamide, phthalamide, methoxycarbonylbenzamide, methoxynaphthoamide, benzylbenzamide, chloroethylbenzamide, chloroethoxybenzamide, cyanobenzamide, and benzyloxybenzamide. Among them, preferred compounds are amide compounds such as o-toluamide, o-chlorobenzamide, p-ethylbenzamide, p-isopropylbenzamide, p-phenylbenzamide, α-toluamide, 2,4-dichlorobenzamide, 2,4-dimethylbenzamide, o-, m- or p-methoxybenzamide, o-, m- or p-ethoxybenzamide, 2,4-diethoxybenzamide, 4-ethoxy-2-hydroxybenzamide, acetoxybenzamide, or o-, m- or p-butoxybenzamide, or arylalkanols such as hydroxybenzoin, p-methylbenzoin, p,p'-dimethylbenzoin, p-methoxybenzoin, xylylene diol, hydroxymethylbiphenyl, hydroxymethyl toluene, p-methoxy benzyl alcohol, α,α-bis-p-chlorophenyl ethanol, p-hydroxybenzyl alcohol, 3-methoxy-4-hydroxybenzyl alcohol, 3-butoxy-4-hydroxybenzyl alcohol, 2,3-dihydroxypropoxybiphenyl, 1-phenoxy-3-p-hydroxyphenoxypropanol, 2-hydroxymethyl-4-phenyl phenol, α, α-bishydroxyphenyl methyl benzyl alcohol, p-carbamoylbenzyl alcohol, p-sulfamoylbenzyl alcohol, and 4-β-penethylbenzyl alcohol.

The above compounds are used together with a core substance of a microcapsule to prepare a microcapsule, or can be added to the coating composition of a heat-sensitive recording material to be present outside of a microcapsule. It is preferred that the above compounds are used with a core substance to prepare a microcapsule. In all cases, the additive amount thereof is from 0.01 to 10 parts by weight, preferably from 0.1 to 5 parts by weight per part by weight of a coupling component. The additive amount can be optionally selected in order to adjust the desired color forming density.

Radical generating agents (i.e., compounds which generate radicals by light-irradiation) used for photopolymerization compositions can be added to the heat-sensitive recording material of the present invention in order to reduce yellow color formed on the background of the recording material after light-fixation. The radical generating agents include aromatic ketones such as benzophenone, 4,4'-bis(dimethylamino)benzophenone, 4,4'-bis(diethylamino)benzophenone, 4-methoxy-4'(dimethylamino)benzophenone, 4,4'-dimethoxybenzophenone, 4-dimethylaminobenzophenone, 4-methoxy-3,3'-dimethylbenzophenone, 1-hydroxycyclohexylphenyl ketone, 4-dimethylaminoacetophenone, or 2-methyl-1-[4-(methylthio)phenyl]-2-morpholinopropane-1-acetophenone-benzyl, cyclic aromatic ketones such as fluorenone, anthrone, xanthone, thioxanthone, 2-chlorthioxanthone, 2,4-dimethylthioxanthone, 2,4-diethylthioxanthone, acridone, N-ethylacridone, or benzanthrone, quinones such as benzoquinone, 2,3,5-trimethyl-6-bromobenzoquinone, 2,6-di-n-decylbenzoquinone, 1,4-naphthoquinone, 2-isopropoxy-1,4-naphthoquinone, 1,2-naphthoquinone, anthraquinone, 2-chloroanthraquinone, 2-methylanthraquinone, 2-tert-butyl anthraquinone or phenanthraquinone, benzoins and benzoin ethers such as benzoin methyl ether, benzoin ethyl ether, 2,2-dimethoxy-2-phenylacetophenone or α-methylol benzoin methyl ether, aromatic polycyclic hydrocarbons such as naphthalene, anthracene, phenanthrane or pyrene, azo compounds such as azobisisobutylonitrile, α-azo-1-cyclohexancarbonitrile, or azobisvaleronitrile, organic disulfides such as thiuram disulfide, and acyloxime esters such as benzyl-(o-ethoxycarbonyl)-α-monooxime.

The radical generating agents are used preferably in an amount of 0.01 to 5 parts by weight, more preferably from 0.1 to 1 part by weight part by weight of diazonium compounds.

Thus, yellow color forming on the background formed after light fixation can be reduced by including the radical generating agents together with diazonium salts as a core substance of a microcapsule.

Further, a polymerizable compound having ethylenically unsaturated bonds (hereinafter referred to as "vinyl monomer") can also be added to the heat-sensitive recording material of the present invention in order to reduce yellow color forming on the background of the material after light fixation. The vinyl monomer referred to herein is a compound having at least one ethylenically unsaturated bond (e.g., a vinyl group, a vinylidene group and the like) in its chemical structure, and which has a chemical form such as a monomer, or a prepolymer, that is, a dimer, a trimer, an oligomer, a mixture thereof and a copolymer thereof. Specific examples thereof include unsaturated carboxylic acids and salts thereof, esters of unsaturated carboxylic acids and aliphatic polyhydric alcohol compounds, amides of unsaturated carboxylic acids and aliphatic polyhydric amine compounds and the like.

The vinyl monomer is used in an amount of from 0.2 to 20 parts by weight, preferably from 1 to 10 parts by weight per part by weight of the diazo compounds.

The vinyl monomer is included in the core substance of a microcapsule with diazo compounds, and in this case, a part of or all of the organic solvents used as a solvent (or dispersion medium) for a core substance can be substituted with vinyl monomers. The additive amounts of the monomer need not be sufficient enough to harden the core substance.

In the case when diazo compounds are included as a core substance in the heat-sensitive recording material of the present invention, an agent which deactivates the coupling agent is added outside of the microcapsule and the diazo compounds present in the water phase and the diazo compounds present in the capsule which are not completely blocked off by the microcapsule wall are reacted with the deactivating agent, whereby the diazo compounds lose their capacity to undergo a coupling reaction (color forming reaction) and therefore fog can be prevented.

The coupling reaction deactivating agents can be any substanes so long as those substances can reduce color formation of a solution having dissolved therein diazo compounds. Whether or not a compound can be used as a coupling reaction deactivating agent can be determined by adding the compound dissolved in water or an organic solvent to the solution of diazo compounds dissovled in water or an organic solvent to see the color change of diazo compounds.

Specific examples include hydroquinone, sodium sulfite, potassium sulfite, hypophosphorous acid, stannous chloride and formalin and the like, and can be those selected from examples disclosed in K. H. Sawnders, *The Aromatic Diazo-Compounds and Their Technical Applications,* M.C., M.A. (Cant at) B.Sc. (London) 1949, pp. 105 to 306.

The preferred coupling reaction deactivating agents are those which are less colored themselves and have less side effects, and the most preferred deactivating agents are those which are water-soluble.

The coupling reaction deactivating agents are used in such an amount that they do not impede the heat color forming reaction of the diazo compounds and generally are used in an amount of from 0.01 to 2 moles, more preferably from 0.02 to 1 mole per mole of diazo compounds.

The coupling reaction deactivating agents are used in such a manner that the deactivating agents are dissolved in a solvent and then added to the dispersion of microcapsules containing diazo compounds, or into the dispersion of a coupling agent or of a basic substance or a mixture thereof. It is preferred that the deactivating agents are used as an aqueous solution thereof.

In the heat-sensitive recording material of the present invention, pigments such as silica, barium sulfate, titanium oxide, aluminum hydroxide, zinc oxide or calcium carbonate and fine particles such as styrene beads or ureamelamine resin can be used in order to prevent sticking to a thermal head or to improve the writing property The pigments and fine particles are used in an amount of from 0.2 to 10 g/m$^2$, preferably from 2 to 5 g/m$^2$.

Metal soaps can also be used to prevent sticking and are used in an amount of 0.2 to 7 g/m$^2$.

In the heat-sensitive recording material of the present invention, a heat-meltable substance can be used to increase heat recording density. The heat-meltable substance is a substance which is solid at a normal temperature and has a melting point of from 50° to 150° C. under heating by a thermal head and dissolved diazo compounds, a coupling component or a basic substance. The heat-meltable substance is used as a dispersion having a particle size of from 0.1 to 10 μm and in an amount of from 0.2 to 7 g/m$^2$ (solid content). Specific examples of the heat-meltable substance include fatty acid amides, N-substituted fatty acid amides, ketone compounds, urea compounds and esters and the like.

A recording layer can be coated by using suitable binders to prepare a heat-sensitive recording material of the present invention.

Binders include various emulsions of polyvinyl alcohol, methyl cellulose, carboxymethyl cellulose, hydroxypropyl cellulose, gum arabic, gelatin, polyvinyl pyrollidone, casein, styrene-butadiene latex, acrylonitrile-butadiene latex, polyvinyl acetate, polyacrylate and a copolymer of ethylene-vinyl acetate. The additive amount is from 0.5 to 5 g/m$^2$ by solid content.

In addition to the materials described above, citric acid, tartaric acid, oxalic acid, boric acid, phosphoric acid, and pyrophosphoric acid can be added as an acid stabilizing agent. The additive amount is from 0.5 to 3 g/m$^2$, preferably 1 to 2 g/m$^2$ by solid content.

The heat-sensitive recording material of the present invention can be prepared by the method which comprises preparing a coating composition containing main ingredients such as diazo compounds, or a coupling component and a basic substance and other additives, coating the thus obtained coating composition on a paper support or a synthetic resin film support by a bar coating method, a blade coating method, an air knife coating method, a gravure coating method, a roll coating method, a spray coating method, a dip coating method and the like and drying it to obtain a heat-sensitive layer having a solid content of from 2.5 to 25 g/m$^2$.

Another method for preparing a heat-sensitive recording material comprises preparing two coating compositions (a first coating composition and a second coating composition), coating the first coating composition on a support and drying it to obtain a precoat layer having a solid content of from 2 to 10 g/m$^2$ and then coating the second coating composition on the precoat layer and drying it to obtain a layer having a solid content of from 1 to 15 g/m$^2$, whereby a laminated layer can be obtained. The first coating composition is prepared by adding a coupling component as a main ingredient, a basic substance and other additives as a core substance of a microcapsule, or dispersing those substances or dissolving those substances in water to prepare an aqueous solution thereof. The second coating composition is prepared by adding diazo compounds as a main ingredient and other additives as a core substance of a microcapsule, or dispersing those substances or dissolving those substances in water to prepare an aqueous solution thereof. The first precoat layer and the second layer can be laminated in reverse order. Coating two layers can be done one after another or can be done simultaneously. Such a laminated layer type heat-sensitive recording material is excellent particularly in long term storage stability bfore recording.

A heat-sensitive layer can be coated after an intermediate layer is provided on a support The paper used as a support is preferably a neutral paper having a heat extraction pH of from 6 to 9 which is sized by a neutral sizing agent such as an alkyl ketene dimer as disclosed in Japanese Patent Application (OPI) No. 14281/80 (corresponding to U.S. Pat. No. 4,255,491) because it provides good storage properties with the passage of time.

To prevent osmosis of the coating solution to the paper and to improve contact between the thermal head and the heat-sensitive recording layer, a paper having Bekk smoothness of 90 seconds or more and meeting the following equation as disclosed in Japanese Patent Application (OPI) No. 116687/82 (corresponding to U.S. Pat. No. 4,416,939) is preferred.

$$\frac{\text{Stockigt sizing degree}}{(\text{meter weighing capacity})^2} \geqq 3 \times 10^{-3}$$

A paper having an optical surface roughness of 8 μm or less and having a thickness of from 40 to 75 μm (as disclosed in Japanese Patent Application (OPI) No. 136492/83), a paper having a density of 0.9 g/cm$^3$ or less and having optical contact degree of 15% or more (Japanese Patent Application (OPI) No. 69091/83), a paper made of pulp beat-treated at 400 cc or more of Canadian standard freeness (JIS P8121) and treated to prevent osmosis of the coating solution (Japanese Patent Application (OPI) No. 69097/83), a paper having improved color forming density and resolving power, whose base paper having a coated gloss surface is prepared by a Yankee machine (Japanese Patent Application (OPI) No. 65695/83 (corresponding to U.S. Pat. No. 4,466,007)) and a paper whose base paper is corona discharge treated to improve the coating property as disclosed in Japanese Patent Application (OPI) No. 35985/84 can be used and give good results in the present invention. Other supports generally used in the field of heat-sensitive recording papers can be also used in the present invention.

The heat sensitive recording material of the present invention can be used as a paper to be printed for facsimile and electronic computers which are required to have high speed recording and can be fixed after printing under heating by dissolving unreacted diazo compound with light exposure. Additionally, the heat-sensitive recording material of the present invention can be used as a heat-developing type copying paper.

The present invention is illustrated in more detail by the following Examples and Comparative Examples, but should not be limited thereto. All parts are by weight.

EXAMPLE 1

3.45 parts of the following diazo compound and 18 parts of an adduct product of xylylene diisocyanate and trimethylol propane (3:1) were added to a mixed solvent of 24 parts of tricresyl phosphate and 5 parts of ethyl acetate and dissovled. The thus obtained solution of the diazo compound was mixed with an aqueous solution having 5.2 parts of polyvinyl alcohol dissovled in 58 parts of water, and was emulsified and dispersed at 20° C. to obtain an emulsion having an average particle size of 2.5 μm. To the thus obtained emulsion was added 100 parts of water, and the mixture was stirred and heated to 60° C. and in 2 hours, a solution of capsules containing diazo compounds as a core substance was obtained.

Diazo Compound

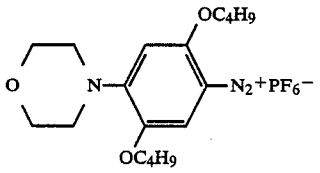

Subsequently, 10 parts of 2-hydroxy-3-naphthoic acid anilide and 10 parts of triphenyl guanidine were added to 100 parts of a 5% aqueous solution of polyvinyl alcohol and were dispersed for about 24 hours by a sand mill to obtain a dispersion of a coupling component and triphenyl guanidine having an average particle diameter of 3 μm.

Into 20 parts of thiohydroquinone derivative as shown in Table 1 were added 100 parts of a 4% aqueous solution of polyvinyl alcohol and 100 parts of water and were dispersed by a paint shaker for 2 hours to obtain a solution of dispersion of thiohydroquinone derivative having an average particle diameter of 3 μm.

Into 50 parts of the thus obtained capsule solution of diazo compound were added 24 parts of the dispersion of a coupling component and triphenyl guanidine and 28 parts of the dispersion of thiohydroquinone derivative to prepare a coating solution. The coating solution was coated on a wood free paper (50 g/m²) using a coating bar so that the dry weight was 10 g/m² and dried at 25° C. for 30 minutes to obtain a heat-sensitive material.

EXAMPLES 2 TO 6

The same procedure as in Example 1 was repeated to obtain a heat-sensitive recording material except that the thiohydroquinone derivatives as shown in Table 1 were used instead of the thiohydroquinone derivative used in Example 1.

COMPARATIVE EXAMPLES 1 to 5

The same procedure as in Example 1 was repeated to prepare a heat-sensitive recording material except that agents for increasing sensitivities as shown in Table 1 were used instead of the thiohydroquinone derivative used in Example 1.

Tests were made in the following manner.

Heat-recording was conducted on the thus obtained heat-sensitive recording materials using a GIII mode thermal printer ("Hifax 700"; a trade name, manufactured by Hitachi, Ltd.), which was wholly exposed using "Recopy Super Dry 100" manufactured by Ricoh Co., Ltd. and fixed. Blue densities of the thus obtained recorded images were measured by a Macbeth reflective densitometer, and yellow densities of the background were also measured in the same manner.

The results are shown in Table 1.

Heat-recording was conducted on the fixed area again and it was observed that images were not recorded thereby confirming that the area to be fixed had positively fixed.

In order to check the decrease of optical densities of color formed areas after long storage of recorded images, the recorded images of the heat-sensitive recording material were stored for 16 hours at 60° C. in darkness to carry out a deliberate deterioration test, and the deterioration was evaluated on three basis.

The results are shown in Table 1.

It is apparent from the results in Table 1 that the compounds of the present invention are effective in remarkably improving image densities and storing recorded images.

TABLE 1

| Recording material | Thiohydroquinone derivatives or sensitivity increasing agents | Image density*1 | Yellow Density at the ground*2 | Decrease of recorded image density after deliberate deterioration*3 |
|---|---|---|---|---|
| Example 1 | 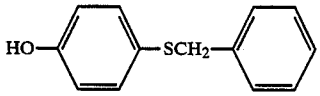  | A | A | A |
| Example 2 | 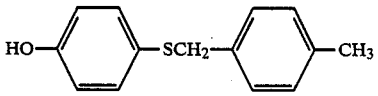  | A | A | A |
| Example 3 | 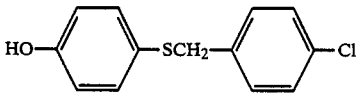  | A | A | A |

TABLE 1-continued

| Recording material | Thiohydroquinone derivatives or sensitivity increasing agents | Image density*1 | Yellow Density at the ground*2 | Decrease of recorded image density after deliberate deterioration*3 |
|---|---|---|---|---|
| Example 4 | 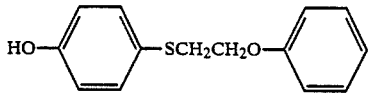 | A | A | A |
| Example 5 | 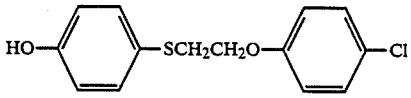 | A | A | A |
| Example 6 | 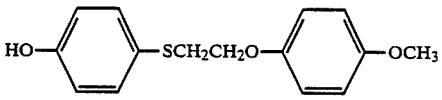 | B | A | A |
| Comparative Example 1 | 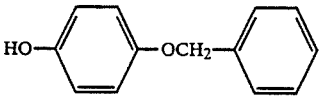 | A | B | B |
| Comparative Example 2 | 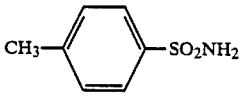 | B | A | C |
| Comparative Example 3 | 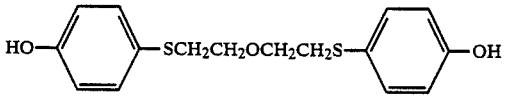 | C | A | B |
| Comparative Example 4 | 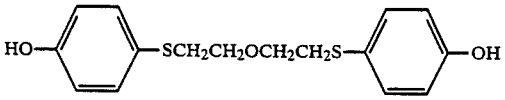 | C | A | C |
| Comparative Example 5 | 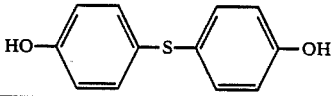 | (The coating composition could not be prepared due to the agglomeration of dispersion) | | |

Evaluation:
*1A: >1.20
B: 1.0 to 1.2
C: <1.0
*2A: <0.8
B: 0.8 to 1.0
C: >1.0
*3Decrease of densities from initial densities;
A: <5%
B: 5 to 10%
C: >10%

While the invention has been described in detail and with reference to specific embodiments thereof, it will be apparent to one skilled in the art that various changes and modifications can be made therein without departing from the spirit and scope thereof.

What is claimed is:

1. A heat-sensitive recording material comprising a support having provided thereon a recording layer consisting essentially of one or more light-fixible diazo salts, a coupling component capable of forming color upon a coupling reaction with said diazonium salt and at least one thiohydroquinone derivative which acts as both a density improving agent and a stabilizing agent, wherein any one of the one or more diazo salts and the coupling component is contained in a microcapsule, and said at least one thiohydroquinone derivative is represented by the

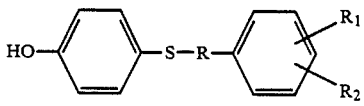

(I-a)

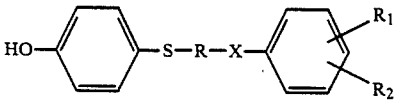

(I-b)

wherein $R_1$ and $R_2$ each represents a hydrogen atom, an alkyl group, an aryl group, an alkoxy group, an aryloxy group, a halogen atom, an acyl group, a carbamoyl group, a sulfamoyl group, a substituted amino group, a cyano group, a nitro group, a carboxyl group or a sulfo group; R represents a substituted or unsubstitued alkylene group having 6 or less carbon atoms; and X represents an oxygen atom or sulfur atom.

2. A heat-sensitive recording material as claimed in claim 1, wherein said at least one thiohydroquinone derivative is used in an amount of from 1 to 8 $g/m^2$.

* * * * *